United States Patent [19]

Okamoto

[11] Patent Number: 4,933,650

[45] Date of Patent: Jun. 12, 1990

[54] MICROWAVE PLASMA PRODUCTION APPARATUS

[75] Inventor: Yukio Okamoto, Sagamihara, Japan

[73] Assignee: Hitachi, Ltd., Tokyo, Japan

[21] Appl. No.: 313,446

[22] Filed: Feb. 22, 1989

[30] Foreign Application Priority Data

Feb. 24, 1988 [JP] Japan ..... 63-39384

[51] Int. Cl.[5] ..... H05H 1/30

[52] U.S. Cl. ..... 333/99 PL; 313/231.31; 315/39; 315/111.41

[58] Field of Search ..... 333/99 PL; 315/39, 111.21, 315/111.41; 313/231.31

[56] References Cited

U.S. PATENT DOCUMENTS 4,438,368 3/1984 Abe et al. ..... 315/39

OTHER PUBLICATIONS

Arams, *Microwave Applications of Gas Discharges*, Electronics, Nov. 1954, pp. 168–172.

Moisan et al., *A Small Microwave Plasma Source, etc.*, IEEE Trans. on Plasma Science, vol. PS-3, No. 2, Jun. 1975, pp. 55–59.

*Primary Examiner*—Paul Gensler

*Attorney, Agent, or Firm*—Antonelli, Terry, Stout & Kraus

[57] ABSTRACT

A microwave plasma production apparatus of the present invention comprises: a circular coaxial wave guide having a cylindrical outer conductor to inject a microwave power from one end and an inner conductor; a metal end plate in which at the other end of the circular coaxial wave guide, the cylindrical outer conductor is set to be longer than the inner conductor, and which is arranged in the edge portion of the cylindrical outer conductor and has a window of an inner diameter which is almost equal to an inner diameter of a cylinder provided for the inner conductor; a gap portion formed between the edge of the inner conductor and the metal end plate; and a discharge tube arranged from the inside of the cylinder of the inner conductor through the window to form a plasma of a material to be transformed to a plasma by the microwave electric field generated in the gap portion.

7 Claims, 5 Drawing Sheets

MICROWAVE PLASMA PRODUCTION APPARATUS

BACKGROUND OF THE INVENTION

The present invention relates to a plasma production apparatus of an analytical apparatus such as plasma reactor of etching, deposition, or the like, plasma source mass spectrometer as a quantitative analysis of elements, or the like and, more particularly, to a plasma production apparatus using microwave energy at an increased power level which is suitable for the above types of apparatus.

Conventional plasma production apparatuses using the microwave power have been disclosed in the following literatures.

(1) THE REVIEW OF SCIENTIFIC INSTRUMENTS, Vol. 36, No. 3, March 1965, pages 294–298;
(2) IEEE Transactions on Plasma Science, Vol. PS-3, No. 2, June 1975, pages 55–59;
(3) THE REVIEW OF SCIENTIFIC INSTRUMENTS, Vol. 39, No. 3, March 1968, pages 295–297;
(4) THE REVIEW OF SCIENTIFIC INSTRUMENTS, Vol. 41, No. 10, October 1970, pages 1431–1433;
(5) JAPANESE JOURNAL OF APPLIED PHYSICS, Vol. 16, No. 11, November 1977, pages 1993–1998; and the like.

In the literatures (1) to (3) of the conventional techniques mentioned above, since a coaxial cable is used to transfer the microwave power, no consideration is made with respect to the point to realize a large power and no solution is given to the problems such as high density and large-diameter of the plasma including the stability in the case of the large power. On the other hand, in the literatures (4) and (5) of the conventional techniques mentioned above, a sufficient consideration is not made with regard to the points such as utilizing efficiency of the microwave, radial distribution of the plasma, and the like and no solution is given to the problems such as production efficiency and uniformity of the plasma and the like.

SUMMARY OF THE INVENTION

It is an object of the present invention to provide a microwave plasma production apparatus for efficiently producing a stable large-diameter plasma of a high temperature and a high density.

According to one aspect of the invention, as shown in FIG. 1B, a microwave circuit is constructed in a manner such that the mode conversion is made from a flat (rectangular) wave guide 40 to a circular coaxial wave guide 50, an outer conductor 52 of the circular coaxial wave guide 50 is formed longer than an inner conductor 51 of the wave guide 50, a metal end plate 70 having a window 72 having an inner diameter which is almost equal to an inner diameter of a cylinder 53 provided in the inner conductor 51 is attached to the cylindrical outer conductor 52 at a position (gap portion) which is away from the front edge of the cylindrical inner conductor 51 by a distance d, and a discharge tube 80 is attached from the inside of the cylinder 53 of at least the inner conductor 51 through the window 72. In such a microwave circuit, by producing a plasma in the discharge tube 80 by using a microwave electric field (surface wave) which is generated in the gap portion, the above object is accomplished.

That is, when microwave power is transferred from the microwave generator to the circular coaxial wave guide through the flat (rectangular) wave guide, a large power of a low loss can be stably supplied to the plasma without using a coaxial cable. Further, by providing the metal end plate 70, the electric field comprising an axial electric field component $E_z$ and a radial electric field component $E_r$ as shown in FIG. 1A, that is, the surface wave is formed in the space (gap d) which is formed between the front edge of the inner conductor 51 and the metal end plate 70. Therefore, a stable plasma of a high temperature, a high density, and a diameter corresponding to a diameter of the discharge tube 80 can be efficiently produced in the discharge tube 80 arranged from the inside of the inner conductor 51 through the window 72 with respect to various kinds of gases in a range from a low pressure to the atmospheric pressure.

DESCRIPTION OF THE PREFERRED EMBODIMENTS

An embodiment of the present invention will be described hereinbelow with reference to Figs. 1A and 1B to FIG. 5.

Figure 1A:
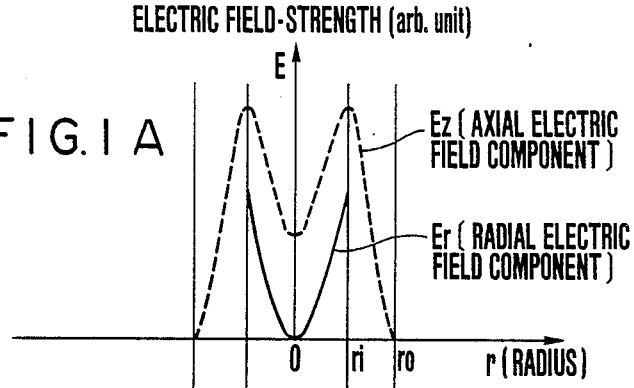
FIG. 1A is a diagram showing a distribution of electric field-strength of the apparatus of FIG. 1B.
Figure 1B:
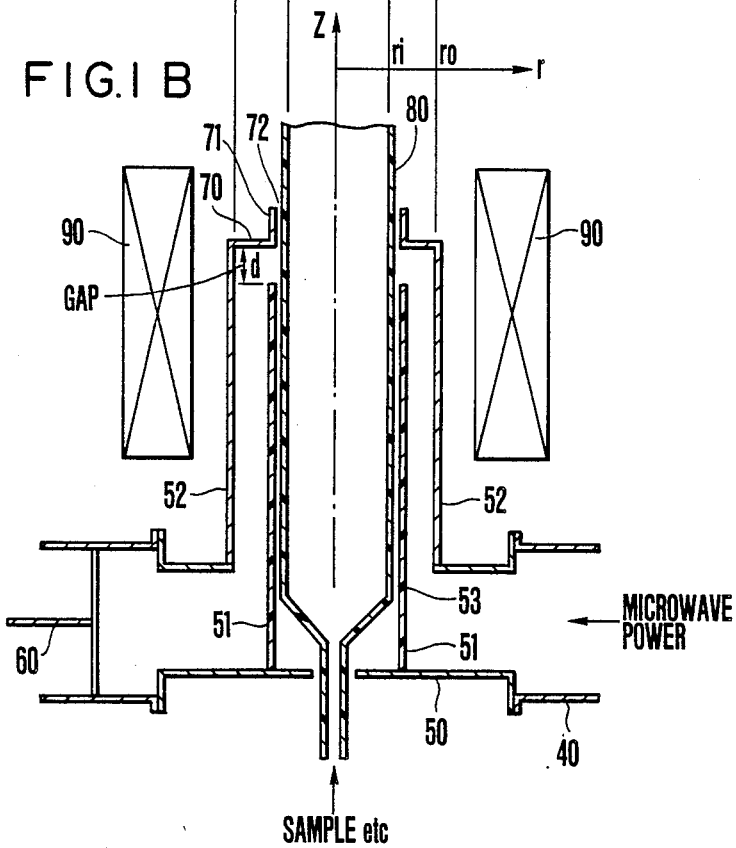
FIG. 1B is a constructional diagram of a main section of a microwave plasma production apparatus according to the present invention.
Figure 5:
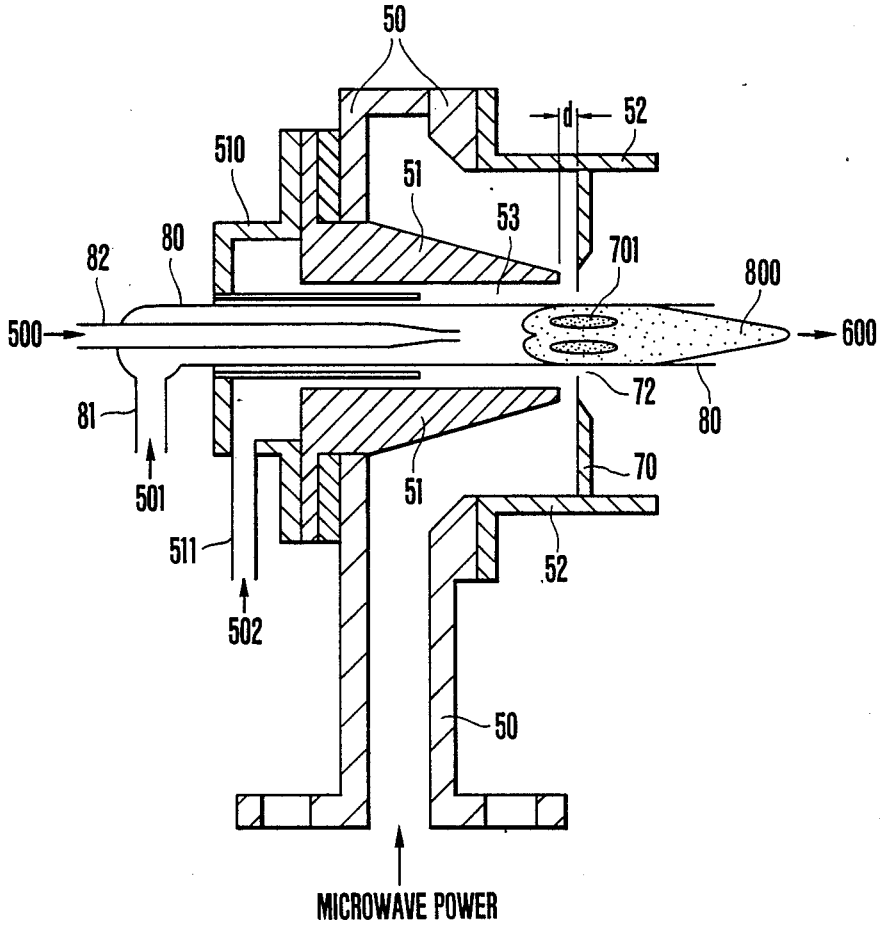
FIG. 5 is a detailed diagram of a microwave induced plasma production system in FIG. 4.

FIG. 1B shows a construction of a main section of a microwave circuit of a microwave plasma production apparatus according to an embodiment of the invention. FIG. 1A diagrammatically shows a distribution of microwave electric field-strength of the apparatus of FIG. 1B. A microwave power is transferred from the flat (rectangular) wave guide 40 to the cylindrical coaxial wave guide transformer 50 comprising at least the inner conductor 51 and the cylindrical outer conductor 52 and is absorbed as a surface wave by a plasma through the insulating discharge tube 80 made of quartz glass or the like which is arranged in the cylinder of the inner conductor 51 or the like through the gap d formed at the edge of the inner conductor 51. The gap d indicates the distance between the edge of the inner conductor 51 and the metal end plate 70 provided for the cylindrical outer conductor 52 and can be varied by a screw, a spacer, or the like. A window 72 having an inner diameter which is almost equal to that of the cylinder 53 of the inner conductor 51 is formed in the metal end plate 70. It is preferable to reduce the loss of microwave by attaching a metal choke 71 as necessary as shown in FIG. 1B. On the other hand, it is preferable to perform the compulsed air cooling or water cooling of at least one of the inner and outer conductors. The diameters of the inner and outer conductors 51 and 52 and of the discharge tube 80 can be arbitrarily set in accordance with the object. Further, since a characteristic impedance of the coaxial circuit is generally set to 50 Ω, in order to efficiently absorb the microwave power to the plasma, it is desirable that a size of E-plane of the flat (rectangular) wave guide portion of the cylindrical coaxial wave guide transformer 50 is set to be smaller (thinner) than the regular size, the ratio to a size of H-plane is reduced, a characteristic impedance of the wave guide is decreased, a ¼ wave length transformer is arranged on the input side of the wave guide, and the characteristic impedance of the wave guide is made coincident with that of the coaxial part. Further, it is preferable that the shape of the inner conductor 51 is set to a door knob type as shown in FIG. 5, the size of a shunt part is set to the regular size, a plunger 60 (variable type) is provided, and thereby enabling the matching to be performed.

On the other hand, a magnetic field generator 90 (comprising a coil, a permanent magnet, and the like) is arranged on the outside of the outer conductor 52. The magnetic field of the divergent type (beach type), having a field intensity for causing the electron-cyclotron-resonance or a field intensity a little higher or lower than that, may be applied to the microwave circuit for the production of a plasma. Due to this, the plasma of a high temperature and a high density (cut-off density or more) can be also more easily obtained even at a low pressure (of course, it is not always necessary to apply the magnetic field).

On the other hand, as a plasma gas, a proper gas is selected from $H_2$, He,$O_2$, $N_2$, Ar, Xe, $CH_4$, $SiH_4$, $NH_3$, $CF_4$, $SiF_4$, and the like in accordance with the object and is operated in a range from $10^{-6}$. Torr to 760 Torr. It is preferable to inject a sample gas into the discharge tube 80 from a tube edge as shown in, e.g., FIG. 1B. However, it is not particularly limited and can be determined in accordance with the object.

Figure 4:
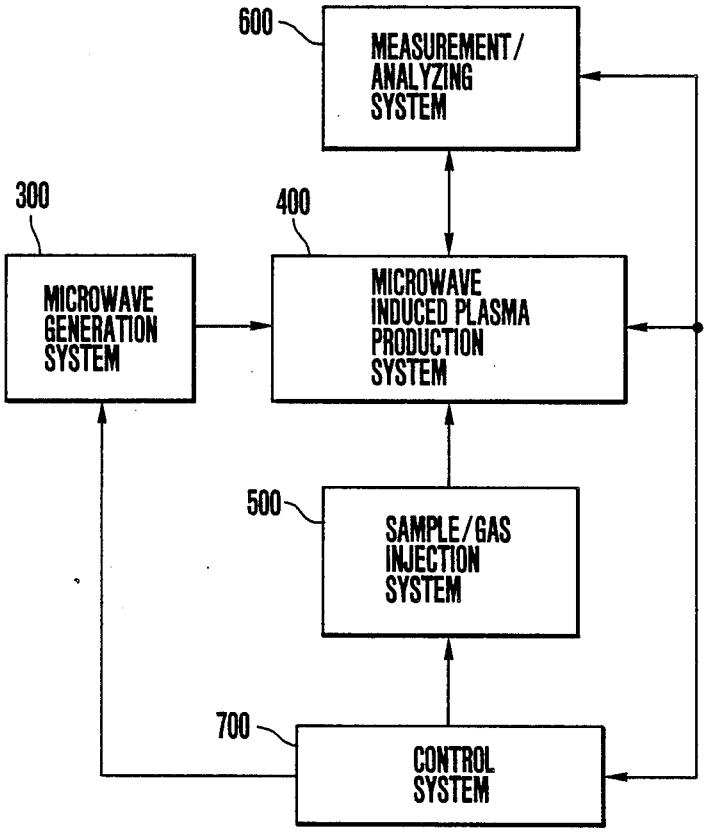
FIG. 4 is a block diagram of an embodiment showing the application of the invention to an analytical apparatus.

FIG. 1A shows the radial component $E_r$ and the component $E_z$ in the direction of a z axis (in the axial direction) of the distribution of electric field-strength in the space of the gap d portion. It is a feature of the plasma production apparatus that the electric field becomes the surface wave in which both of the $E_r$ and $E_z$ components exist and both components on the z axis are weak and, on the contrary, the electric field on the outside is strong and the electric field functions so as to obtain the plasma which is uniform in the radial direction in the case of a low pressure due to the double effects of those components and a diffusion of the sample gas particles. On the other hand, at a high pressure, as shown in FIGS. 4 and 5, a doughnut (toroidal) shape plasma is obtained. The pressure is selected in accordance with the object.

Figure 2:
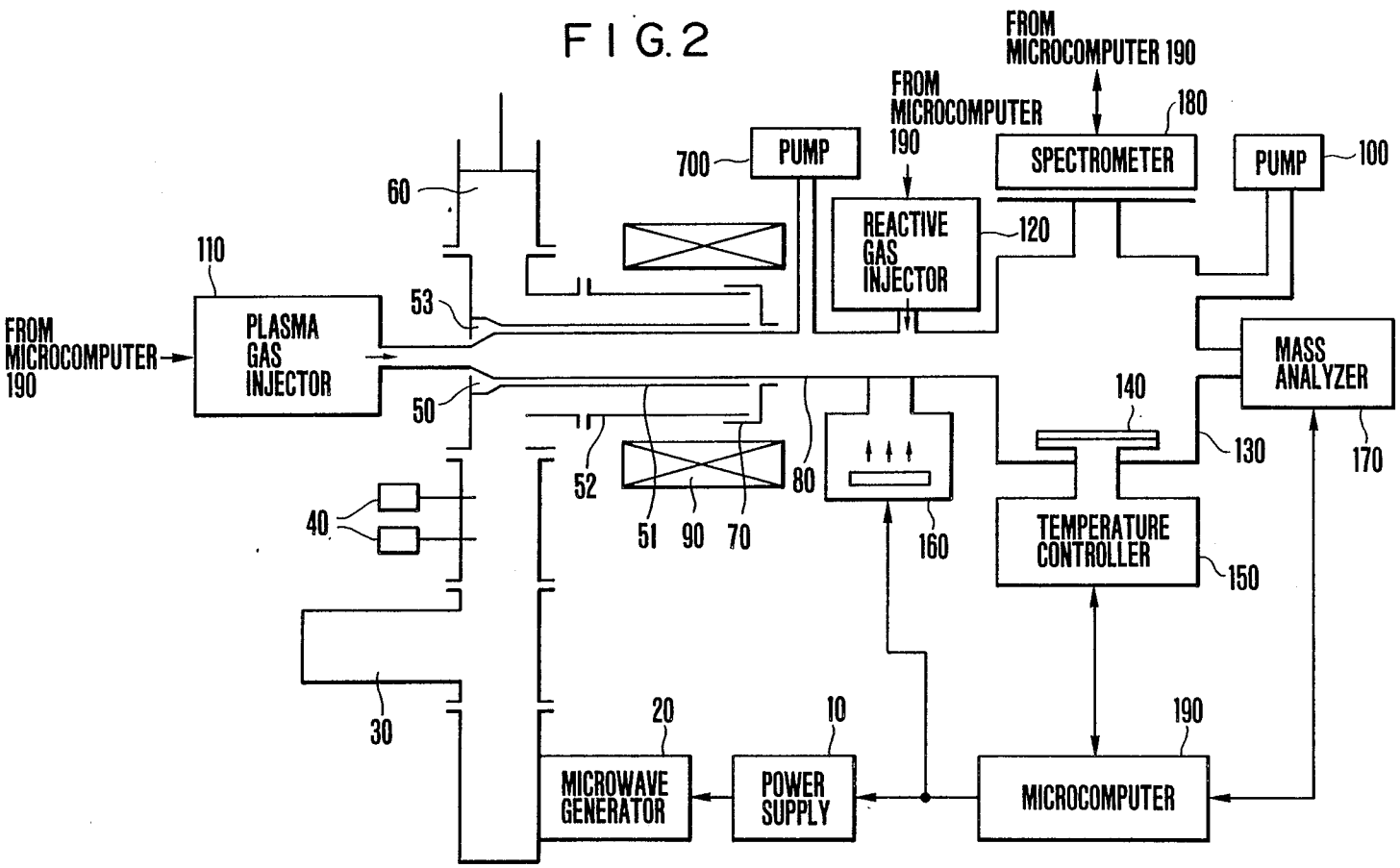
FIG. 2 is a constructional diagram of an embodiment showing the application of the invention to a plasma reactor.

FIG. 2 shows a block diagram of the second embodiment of the invention in the case where the microwave plasma production apparatus shown in FIG. 1B is applied to a plasma reactor for etching, deposition, further, production of new materials, and the like. Reference numeral 10 denotes a high voltage power supply (DC or pulse); 20 indicates a microwave generator (magnetron or gyrotron; 1 to 100 GHz, 10 to 5000 W); 30 an isolator (or uni-line); 40 the microwave circuit (comprising a stub tuner, a directional coupler, a power meter, an E-H tuner, and the like); 50 the coaxial wave guide transformer; 51 the inner conductor; 52 the cylindrical outer conductor; 60 the plunger; 70 the metal end plate; 80 the discharge tube; 90 the magnetic field generator (it is not always necessary to provide the generator 90); 100 an evacuation apparatus such as an evacuation pump; 110 a plasma gas (such as-Ar, He, $O_2$, etc.) injector; 120 a reactive gas (such as $CH_4$, $NH_3$, $CF_4$, SiF4, $O_2$, etc.) injector; 130 a reactor; 140 a sample (such as a semiconductor wafer or the like) holder (substrate); 150 a temperature controller (comprising a cooler or a heater and the like); 160 a reaction fine-particle (for instance, in the case of forming a high temperature superconducting thin film, for example, $BaCO_3$-$+Y_2O_3+$ CuO or the like is evaporated by an electron beam or the like and the resultant fine particles are injected) injector; 170 a mass analyzer; 180 a spectrometer; and 190 a microcomputer to automatically control (optimize) each apparatus. For instance, the microcomputer 190 performs the data arrangement. In the embodiment, the gap d can be varied by adjusting the metal end plate 70 by using a screw, a spacer, or the like. On the other hand, a diameter of inner conductor 51 is set to a large value in the portion of the coaxial transformer 50 (door knob type).

By constructing as mentioned above, for instance, when an oxide high temperature superconducting thin film is formed, oxygen ($O_2$) as a plasma gas can be ionized at a low pressure (10−4 Torr or less). The radical or ions of oxygen of a low energy which are generated at that time and the metal atoms of, for instance, Ba, Y, or Cu injected as the reaction fine particles 160 physically and chemically react. A film of a good quality can be manufactured onto the substrate on the sample holder 140 at a low temperature and in a short time while optimizing by the microcomputer 190.

Figure 3:
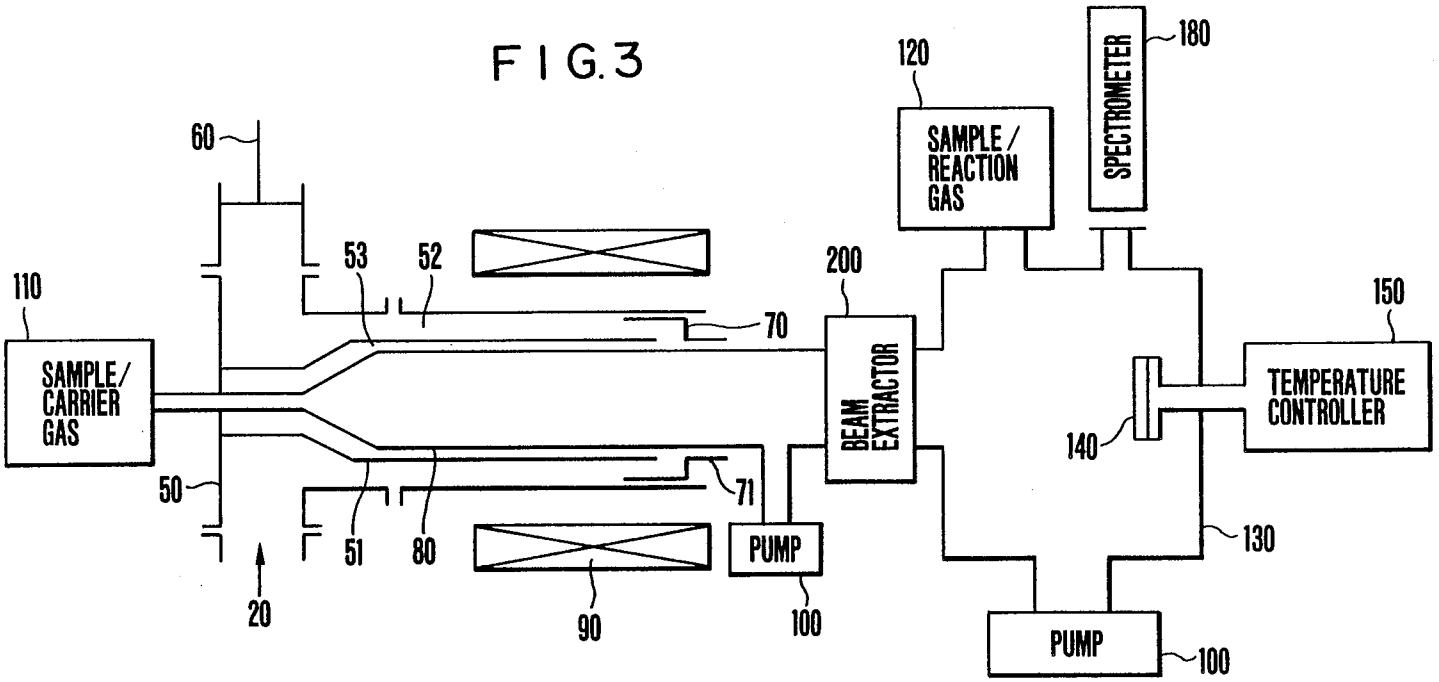
FIG. 3 is a constructional diagram of an embodiment showing the application of the invention to an ion source and its process.

FIG. 3 shows the third embodiment of the invention. The third embodiment shows an apparatus for extracting ions or neutral particles from the plasma and executing the surface modification and treatment of a material. In the diagram, reference numeral 50 denotes the cylindrical coaxial wave guide; 51 indicates the inner conductor; 52 the cylindrical outer conductor; 60 the plunger; 70 the metal end plate (which can be variably modified); 71 the metal choke; 80 the discharge tube; 90 the magnetic field generator (it is not always necessary to provide the generator 90); 100 the evacuation pump; 110 the injector of a sample gas, a carrier gas, or the like; 120 the injector of a sample gas, a reactive gas, or the like; 130 the reactor; 140 the sample holder; 150 the temperature controller; 180 the spectrometer; and 200 a beam (ion, etc.) extractor. The beam extractor 200 can be also constructed as an electron or neutral beam (atom or radical) extractor.

By constructing as mentioned above, a uniform plasma of a sample gas or a carrier gas of a large diameter and a high density can be produced. For instance, a uniform ion beam of a large diameter and a high density is extracted from the plasma by using the beam extractor 200. The surface treatment or surface modification of the substrate set on the sample holder 140 can be executed in a short time and at a low temperature. On the other hand, a target is sputtered by an ion beam and the target material can be also deposited onto the substrate. Further, the surface treatment or the like can be also executed by using the neutral particles.

FIG. 4 shows a fundamental construction of the fourth embodiment of the invention which is applied to a trace elements analysis or the like of biology or the like. In the diagram, reference numeral 300 denotes a microwave generation system comprising: a microwave generator such as a magnetron; a high voltage power supply; a microwave power meter; an E-H (or stab)

tuner; etc. Reference numeral 400 denotes a microwave induced plasma production system which is fundamentally based on the construction shown in FIG. 1B and comprises the cylindrical coaxial wave guide, inner conductor, metal end plate, discharge tube, etc. as shown in FIG. 5. Reference numeral 500 denotes a sample/gas injection system comprising a sample, a carrier gas, a nebulizer, and the like. Reference numeral 600 denotes a measurement/analyzing system comprising a spectrometer, a mass analyzer, and the like. Reference numeral 700 denotes a control system comprising a microcomputer and the like. The control system 700 executes the data arrangement, optimum control of the apparatus, and the like. In the embodiment, since a large power can be stably supplied as an operating pressure, the atmospheric pressure is fundamentally considered, and it is sufficient that the diameters of the discharge tube and the like are also set to be smaller than those in the second and third embodiments.

FIG. 5 shows the details of an embodiment of the plasma production system 400 in FIG. 4 of the invention. In the diagram, reference numeral 50 denotes the coaxial wave guide transformer which is made of copper, aluminum, or the like and is formed in a flat type wave guide (inner dimensions are set to 8.6 mm $\times$ 109.2 mm $\times$ 84 mm). Reference numeral 51 denotes the inner conductor made of copper or the like (the shape of the coaxial transformer portion is set to, for instance, a conical frustum (for instance, a diameter of the bottom portion is set to 40 mm, a diameter of the upper portion is set to 15 mm, and a height is set to 30 mm) as shown in the diagram). A cylindrical cavity 53 (having a diameter of, e.g., 4 to 12 mm) for allowing the discharge tube 80 to pierce therein is formed in the axial upper portion of the inner conductor 51. Reference numeral 52 denotes the cylindrical outer conductor made of copper or the like. The disk end plate 70 made of copper or the like is attached to the outer conductor 52. The window 72 of an inner diameter which is almost equal to the inner diameter of the cylindrical cavity 53 provided for the inner conductor 51 is formed in the end plate 70. A thickness of the inner periphery of the window 72 is concentrically made thinner (thickness $\geqq$0.1 mm) than that of the outer peripheral portion. Further, the gap d (0.5 to 20 mm) between the edge portion of the inner conductor 51 and the end plate 70 can be adjusted.

Reference numeral 80 denotes the discharge tube (inner diameter: e.g., 4 to 10 mm) made of quartz glass or the like. One end of the discharge tube 80 is opened and the other end is formed with a branch tube 81 so that a plasma gas 501 (He, $N_2$, Ar, etc.) can be supplied in the radial direction. On the other hand, an inner tube 82 made of quartz glass or the like is coaxially formed from the other end portion of the discharge tube 80. A carrier gas (the same kind as the plasma gas 501) or the like is injected from the injection system 500 together with a sample from one end of the inner tube 82 through a nebulizer (not shown) or the like. Reference numeral 510 denotes a freezer to cool the discharge tube 80, inner conductor 51, and the like. The freezer 510 supplies a coolant 502 (for instance, air) from a coolant entrance 511. By constructing as mentioned above, not only the discharge tube 80 but also the inner conductor 51 and end plate 70 can be efficiently cooled. Reference numeral 800 denotes a diffused plasma and 701 indicates a doughnut shape hot plasma. The shapes and sizes of the discharge tube 80, inner conductor 51, and the like are not limited.

By constructing as mentioned above, the microwave power (for instance, 2.45 GHz, $\lesssim$2 KW) supplied to the coaxial wave guide transformer 50 is concentrated to the gap d portion between the inner conductor 51 and the metal end plate 70 and a field distribution as shown in FIG. 1A is obtained.

Therefore, the plasma gas 501 injected from the branch tube 81 is ionized and the doughnut shape hot plasma 701 is produced in the discharge tube 80. When the sample to be analyzed or the like is injected from the injecting system 500 via the inner tube 82 into the central portion of the plasma 701, the sample is not diffused to the surrounding but the dissociation $\rightarrow$ excitation $\rightarrow$ ionization are efficiently caused. When the light generated at that time is led to the spectrometer 180 and the ions are injected to the mass analyzer 600 or 170 through an ion sampling interface system (not shown), the sample can be quantitatively analyzed at a high sensitivity as compared with the case whereby a radio frequency (for instance, 27 MHz) inductively coupled plasma is used. On the other hand, even a sample of a solvent can be also directly analyzed and, further, an organism sample and the like can be also analyzed and the sample is not particularly limited. On the other hand, He, $N_2$, Ar, or the like can be also used as a plasma gas and it is not particularly limited.

Further, the microwave plasma production apparatus described above can be applied to all of the apparatuses using a plasma. The plasma can be also produced like pulses.

As mentioned above, in the foregoing microwave plasma production apparatus, the microwave power of a large magnitude can be stably supplied without using a coaxial cable since the plasma and surface wave are coupled in the gap d provided for the cylindrical coaxial wave guide. Moreover, the microwave power can be efficiently absorbed to the plasma. Thus, there is an advantage such that a plasma of a high temperature, a high density, and a large diameter can be produced in a wide range from a low pressure (about $10^{-6}$ Torr) to a high pressure (atmospheric pressure) with respect to various kinds of gases.

Further, by superposing the external magnetic field, a plasma of a high density of a cut-off density or higher can be produced with respect to various kinds of gases.

Therefore, the plasma of the invention can be applied to production of new materials, surface working, surface modification, and the like as well as the etching and deposition. Further, there is an advantage such that the plasma can be widely used as a light emission and ion source and the like in the elements analysis and the like.

What is claimed is:

1. A microwave plasma production apparatus comprising:

a circular coaxial wave guide having a cylindrical outer conductor and a hollow inner conductor having an inner diameter defining a cylindrical cavity;

means for supplying microwave power at a first end of said circular coaxial wave guide;

a metal plate at a second end of said circular coaxial wave guide, said plate extending in a transverse direction to the cylindrical outer conductor and having a window with an inner diameter that is substantially equal to the inner diameter of said inner conductor;

a gap formed between said metal plate and a facing end edge of the inner conductor; and a discharge tube positioned inside said cylindrical cavity and through said window and being effective to confine at said gap portion a material to be transformed into a plasma by an electric field caused by said microwave power.

2. An apparatus according to claim 1, wherein a length of said gap can be varied.

3. An apparatus according to claim 1, wherein said discharge tube has an injection entrance to inject the material to be transformed into the plasma and an opening to use said plasma.

4. An apparatus according to claim 1 wherein the microwave power supplying means constitutes a hollow rectangular wave guide that is angularly disposed relative to said circular coaxial wave guide.

5. A microwave plasma production apparatus comprising:

a circular coaxial wave guide having a cylindrical outer conductor and a hollow inner conductor having an inner diameter defining a cylindrical cavity;

means for supplying microwave power at a first end of said circular coaxial wave guide;

a metal plate at a second end of said circular coaxial wave guide, said plate extending in a transverse direction to the cylindrical outer conductor and having a window with an inner diameter that is substantially equal to the inner diameter of said inner conductor;

a gap formed between said metal plate and a facing end edge of the inner conductor;

a discharge tube positioned inside said cylindrical cavity and through said window and being effective to confine at said gap portion a material to be transformed into a plasma by an electric field caused by said microwave power and;

magnetic field applying means provided around said gap portion to superpose an external magnetic field to said microwave electric field.

6. A microwave plasma production apparatus comprising:

a circular coaxial wave guide having a cylindrical outer conductor and a hollow inner conductor having an inner diameter defining a cylindrical cavity;

means for supplying microwave power at a first end of said circular coaxial wave guide;

a metal plate at a second end of said circular coaxial wave guide, said plate extending in a transverse direction to the cylindrical outer conductor and having a window with an inner diameter that is substantially equal to the inner diameter of said inner conductor;

a gap having a length which can be varied formed between said metal plate and a facing end edge of the inner conductor;

a discharge tube positioned inside said cylindrical cavity and through said window and being effective to confine at said gap portion a material to be transformed into a plasma by an electric field caused by said microwave power and;

magnetic field applying means provided around said gap portion to superpose an external magnetic field to said microwave electric field.

7. A microwave plasma production apparatus comprising:

a circular coaxial wave guide having a cylindrical outer conductor and a hollow inner conductor having an inner diameter defining a cylindrical cavity;

means for supplying microwave power at a first end of said circular coaxial wave guide;

a metal plate at a second end of said circular coaxial wave guide, said plate extending in a transverse direction to the cylindrical outer conductor and having a window with an inner diameter that is substantially equal to the inner diameter of said inner conductor;

a gap formed between said metal plate and a facing end edge of the inner conductor;

a discharge tube positioned inside said cylindrical cavity and through said window and being effective to confine at said gap portion a material to be transformed to superpose an external into a plasma by an electric field caused by said microwave power, said tube having an injection entrance to inject the material to be transformed into the plasma and an opening to use said plasma; and magnetic field applying means provided around said gap portion to superpose an external magnetic field to said microwave electric field.

* * * * *